United States Patent [19]

Pemberton

[11] Patent Number: 5,050,276

[45] Date of Patent: Sep. 24, 1991

[54] MAGNETIC NECKLACE CLASP

[76] Inventor: J. C. Pemberton, P.O. Box 20005, San Diego, Calif. 92120

[21] Appl. No.: 537,854

[22] Filed: Jun. 13, 1990

[51] Int. Cl.[5] ..... A44B 21/00

[52] U.S. Cl. ..... 24/303; 24/616

[58] Field of Search ..... 24/303, 497, 94, 688, 24/615, 616, 618; 292/251.5; 248/206.5

[56] References Cited

U.S. PATENT DOCUMENTS

| | | | |
|---|---|---|---|
| 2,178,572 | 11/1939 | Forstner | 24/616 |
| 3,111,736 | 11/1963 | Budreck | 24/303 |
| 3,129,477 | 4/1964 | Mizuno | 24/303 |
| 3,186,052 | 6/1965 | Bobrow | 24/303 |
| 3,621,690 | 11/1971 | Whitcomb | 24/303 |
| 4,231,137 | 11/1980 | Fujimoto | 24/303 |

*Primary Examiner*—Victor N. Sakran

*Attorney, Agent, or Firm*—Jessup, Beecher & Slehofer

[57] ABSTRACT

A magnetic clasp has two mirror image halves each of which is attached to the ends of a necklace. Each half has a magnetic shell and an inserted magnetic core. The shell has a cylindrical body with a cone-shaped end. The front of the shell has an open cavity for inserting the magnetic core. The front of the shell and magnetic core form a flat surface. The magnetic core is made of samarium cobalt or neodymium iron. Both are strong magnets and allow the clasp to be very small in size so that it is aesthetically pleasing and lightwise. The end of each half has an eyelet for connecting to a necklace. A conventional fastener can be soldered to one eyelet so that the clasp can be added to an existing necklace. A safety catch can be added to the clasp as a back-up safety feature for expensive jewelry.

8 Claims, 1 Drawing Sheet

MAGNETIC NECKLACE CLASP

BACKGROUND OF THE INVENTION

1. Field of the Invention

JEWELRY—combination articles and bracelets: two parts with a single hinge; magnetic clasp with safety catch.

2. Description of the Prior Art

Prior art magnetic necklace clasps are so heavy that they tend to slide down the back of the wearer's neck and pull the necklace taut against the wearer's throat in the front. With the new permanent magnetic materials available, the magnetic clasp has now become practical and it has been reduced to practice having a solid cylindrical shape with a 3/16 inches (4.6 mm) diameter, which is a practical size and weight.

SUMMARY OF THE INVENTION

A magnetic clasp has two mirror image halves each of which is attached to the ends of a necklace. Each half has a magnetically permeable shell which forms a conventional magnetic flux return path and an inserted permanent magnetic core. The magnetically permeable shell has a cylindrical body with a cone-shaped end. The front of the permeable shell has an open cavity for inserting the magnetic core. The front of the permeable shell and magnetic core form a flat surface. The magnetic core is made of samarium colbalt or neodymium iron. Both are strong magnets and allow the clasp to be very small in size so that it is aesthetically pleasing and lightweight. The non-flat end of each half has an eyelet for connecting to a necklace. A conventional non-magnetic can be easily soldered to one eyelet so that the clasp can be added to an existing necklace by the customer. A safety catch can be added to the clasp as a back-up safety feature for expensive jewelry. This invention relates to the use of magnetic attraction to latch the free ends of a necklace or bracelet. It teaches the use of neodymium iron or samarium cobalt to achieve a strong, quick to use necklace clasp which is small and light enough so that it does not slide down the back of the neck. Until recently, the best permanent magnetic material was alnico5 which has 5.5 MG·Oe (Mega Gaus×Orstads). Alnico is an acronym for the alloy comprising aluminum, nickel, cobalt and iron. This value is maintained only if the "keeper" is not removed. The instant the "keeper" is removed, the above value for alnico5 drops to 3 MG·Oe "in air." In the present invention, a keeper can not be used to maintain the 5.5 MG·Oe when the clasp is opened.

The trade uses the term "in air" for the condition when the magnet "keeper" is not used. The holding force of any magnetic material is proportional to the cross-sectional area of the magnet. Thus to develop the same holding force with the old alnico5 "in air" as the force for 0.125 inches in diameter (used for the reduction to practice) magnet of samarium cobalt which has 20 MG·Oe in air, the area must be increased 20/3 or 6.6 times. This results in the magnet diameter increased from 0.125 to 0.364 inches. Now multiply this by the ratio of 0.187/0.125 to add the magnetic return path shown in FIG. 1*b*. Now the diameter of the alnico clasp would increase to 0.542 inches in diameter for the alnico5 clasp, which is much too heavy for necklace or bracelet clasp use. The neodymium iron has a 35 MG·Oe value in air, which will make the equivalent alnico clasp even heavier. The resulting size of this new magnetic clasp is actually smaller than the diameter of the old commercial spring ring clasp.

The prior art discloses various magnetic necklace clasps. They fall into at least two categories. The first category employs two identical magnetic ends which are simply attracted to each other. As previously stated, they were so heavy that they were never commercialized or made it to the marketplace. The second category is a combination of the magnetic attraction that holds two generally dissimilar ends together by virtue of a "hooking" geometry. The drawback in this second category clasp is that the two ends must be very carefully brought together, so that the mechanical "hooking" feature can engage. This is very difficult to hook together while being manipulated blindly behind the head. Once engaged, it is held together by the old small magnets.

Accordingly, it is a purpose of this invention to provide a strong attraction between two simple magnetic ends, which simply "jump" together when they are brought into close proximity to each other, and have enough attractive force to connect the ends of and secure a costume-type necklace. Another advantage of this simple type is that small children often pull on the mothers' necklace and break the string of beads. This simple magnetic clasp with samarium cobalt will uncouple when between ¾ and 1 pound of force is applied to pull apart the clasp. The magnetic ends will uncouple first and will prevent the breaking of the string of beads. Neodymium iron is 1.76 times stronger magnetically than is samarium cobalt.

This invention also provides another category of clasps that are designed to secure a very expensive necklace. The same samarium cobalt and neodymium iron magnets are used as previously described, but a mechanical swinging spring catch has been added so that after the magnets have "jumped" together by magnetic attraction, a simple pressing of the thumb and finger can secure a hinged, pivotable, mechanical spring catch to greatly increase the strength of the junction. Thus the prior art drawback which requires that the two ends must be very carefully brought together blindly behind the head is completely eliminated.

The ends of both the samarium cobalt and neodymium iron magnetic clasps are fitted with an in situ eyelet. A commercial spring ring, sister clamp, or other commercial nonmagnetic clasp is installed into one of the above in situ eyelets at the factory so that this magnetic clasp is detachable and can be quickly transferred from one necklace to another necklace at the option of the user. This transfer is possible only because the gold soldering of this commercial clasp to one of the in situ eyelets is done at the factory. The transfer is also made easy because it is done in front of the eyes, not behind the head and under the hair. The magnetic clasp invention can be physically removed from the attached necklace and reattached to another necklace by means of this commercial clasp means which is gold soldered into the eyelet end of a magnetic shell at the factory.

DETAILED DESCRIPTION OF THE INVENTION

Figure 1A:
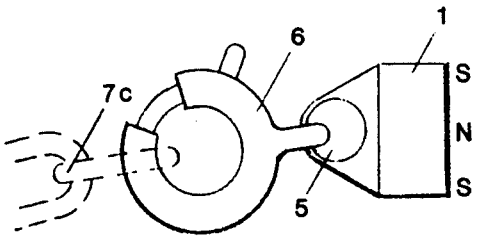
FIG. 1*a* is an elevational view of the left magnetic clasp half.

Most standard necklaces have a closed ring attachment 7C at one end and an openable and closeable fastener 6C or 8C at its other end. The two opposite ends hook and lock together to keep the necklace secured around the wearer's neck. The present invention is intended to be attached to and interposed between the closed ring end 7C and fastener ends 8C or 6C of a standard necklace so that the eyelet 5 on the right hand clasp half 2 accepts the necklace fastener 6C or 8C, and the left hand clasp half 1 has a gold soldered fastener 6, 8 or 9 for hooking to the ring end 7C of the necklace. The present invention can be marketed as a magnetic clasp that can be temporarily secured to an existing necklace. The invention can be sold as an inexpensive add-on after market product for jewelry by any store because it does not require the skill for using gold soldering equipment.

The present invention utilizes a pair of identical magnetic pieces, or shells, which are lined up with each other in a mirror image fashion to make physical contact by magnetic attraction to temporarily hold the opposite ends of a necklace to prevent the necklace from falling off the wearer's neck. It functions as a clasp. For discussion purposes, the two pieces are defined as a left half and a right half. Each half is attached to each opposite end of a conventional necklace or bracelet. Each half has a cylindrical portion and a cone-shaped portion. The cylindrical portion holds a permanent magnetic core, and the cone-shaped portion is used for attachment purposes. The cylindrical portion has an open cylindrical cavity for the insertion of and for holding the magnetic core in place with a nonmagnetic cement. The magnetic core is a solid cylinder in configuration, and is made of neodymium iron or samarium cobalt. Both magnetic materials are strong magnets. $SmCo_5$ is a permanent-magnet alloy and is five times stronger than conventional magnets. Both types of magnets are commercially available. Either magnetic core could have any configuration in addition to being cylindrical in shape. The only requirement is a flat surface portion for making good contact with the mating magnet. The cylindrical configuration for the magnetic core is the best mode, because it is easy to make a cylindrically-shaped section of magnetic material, and then cut it transversely for the desired length Samarium Cobalt. The two opposite facing magnetic cores must be inserted in their respective cylindrical cavities so that their polarities are reversed so that they will be attracted to one another. Each magnetic core can be tested and marked to show its polarity so that it can be properly configured when it is cemented in the cavity.

The overall shape of either half can be changed to any variety of configurations. The cylindrical body and cone-shaped tip configuration for the shell is the best mode to use, because it is easy to manufacture. However, the invention is not intended to be limited to this configuration. The cone-shaped tip could be configured as a hook, arm, or rod for example, and the cylindrical body could be square or polygonal in cross section. The shell is fabricated from magnetically permeable metal, iron being preferred.

Figure 1C:
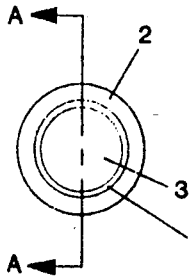
FIG. 1*c* is an end view of the right magnetic clasp half.
Figure 1B:
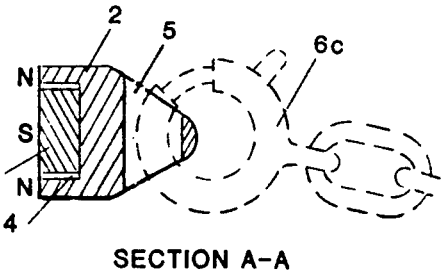
FIG. 1*b* is sectioned to show the internal magnetic north and south poles, and also the in situ eyelet on the right half.

FIGS. 1*a*, *b*, and *c* show both halves 1 and 2 of the complete magnetic clasp with the magnetic poles designated as N for north and S for south. FIG. 1*a* is an elevational view of the left magnetic clasp half 1. This also shows the eyelet 5 and commercial fastener 6 soldered to it for attaching to the closed ring attachment end 7C of the necklace shown in dashed lines. The eyelet 5 will be referred to hereafter as an in situ eyelet 5. FIG. 1*b* is a sectional view taken along the line A—A in FIG. 1*c* showing the internal construction of both the left and right halves of the magnetic clasp. The tapered magnetic shell 1 or 2 is made of a magnetically permeable material. The magnet 3 is cemented into the cavity in the face of the shell 2 with non-magnetic cement 4. A south pole is shown on the face center of the magnet 3, which is ready and willing to couple with the left magnetic clasp half shown in FIG. 1*a*, which shows a north pole on its face center. The eyelets 5 shown in the non-magnetic ends of both halves in FIG. 1*a* and FIG. 1*b* represent in situ eyelets 5 for attaching a necklace to the invention. FIG. 1*a* shows a commercial spring ring gold soldered to this in situ eyelet 5, ready to accept the standard closed ring attachment end 7C of the customer's necklace, which is shown in dashed lines.

FIG. 1*b* shows the mirror image of the in situ eyelet 5 in in cross section and rotated 90 degrees relative to FIG. 1*a*. The other end of the customer's necklace, which can have the identical commercial spring ring 6C as that soldered to the left clasp half, is demountably engaged within this in situ eyelet 5 in the right half portion of the magnetic clasp. The commercial "spring ring" clasp 6C is illustrated with dashed lines to show that it is part of the customer's necklace and is not considered part of the present invention. The reason for showing the opposite ends of the necklace in dashed lines is to teach that the magnetic clasp can be quickly removed and transferred to another necklace, if so desired by the user.

Figure 2A:
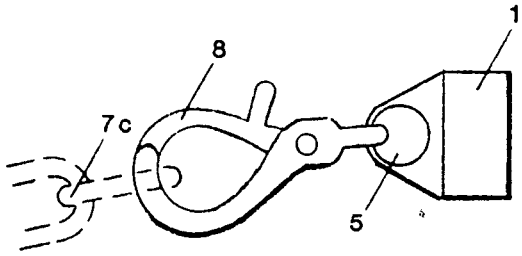
FIG. 2*a* shows the left half of the magnetic clasp with a means for connecting to the end ring of the customer's necklace.
Figure 2B:
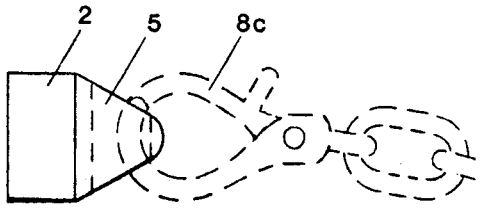
FIG. 2*b* is similar to FIG. 1*b*, but shows the use of a commercial sister clamp engaging the in situ eyelet on the end of the right magnetic clasp half.

FIG. 2*a* shows the same left magnetic clasp half 1 as in FIG. 1*a*, with a different type of commercial "sister clamp" clasp 8, permanently gold soldered to the in situ eyelet 5 for quick attachment to the closed ring attachment end 7C of the customer's necklace shown in dashed lines. The other end of the customer's chain can have a fastener "sister clamp" identical to fastener 8, labelled 8*c*, which is attached to the eyelet 5 in the right half of the magnetic clasp. FIG. 2*b* is identical to FIG. 1*b* except it is illustrated as an elevational view. The commercial fastener "sister clamp" 8*c* is shown demountably engaged with the in situ eyelet 5. Again, this is illustrated to teach that this magnetic clasp can be transferred to any number of conventional-type necklaces.

Figure 3:
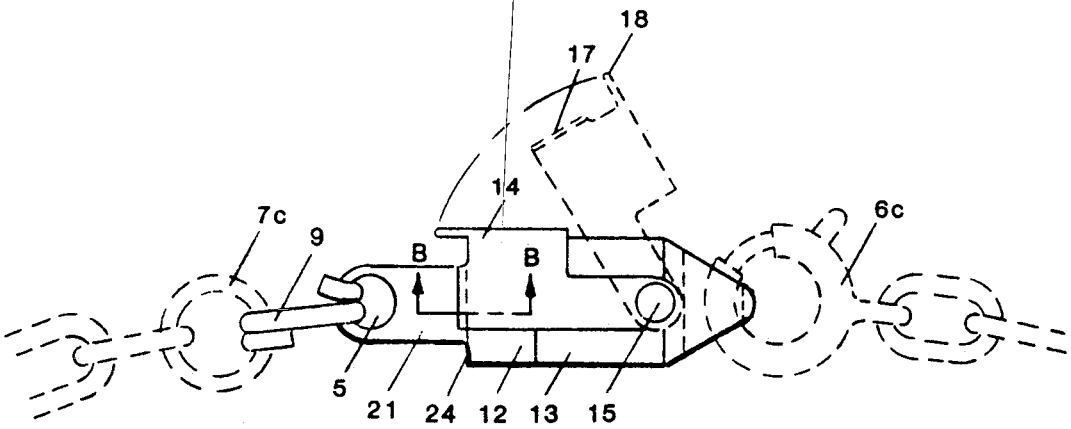
FIG. 3 shows the arrangement of the magnetic clasp with the addition of a swinging mechanical spring catch, which is used for very expensive necklaces.
Figure 4:
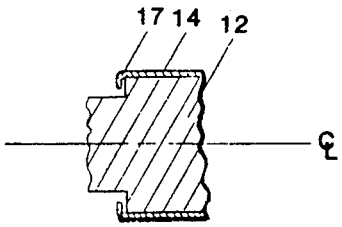
FIG. 4 is a fragmentary sectional view of part of FIG. 3 showing the "hook" detail.
Figure 5:
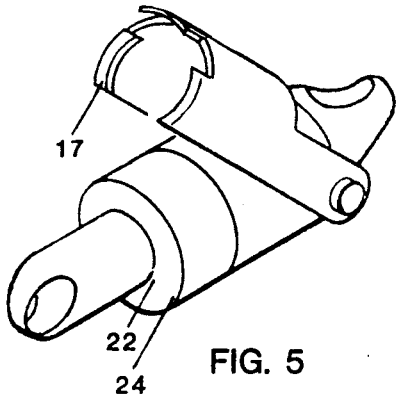
FIG. 5 is an isometric drawing of FIG. 3.

FIGS. 3 and 5 show the second category mentioned in the Summary, which can be used with an expensive piece of jewelry as a safety back-up catch has been added in case the magnetic clasp accidently disengages. It incorporates a swinging mechanical spring safety catch 14, which pivots on a pivot pin 15. The catch is formed as a little more than a hemicylindrical shell with the top of the right portion removed. The catch 14 is made of spring brass and is formed to fit closely around the cylindrical shape of the coupled left half magnetic shell 12 and the right half magnetic shell 13 so that it snaps onto this cylindrical shape and is held in the locked mode. The left half magnetic shell 12 has a cylindrically shaped body having a front flat face and a rear flat face 22. There is a rim 24 where the rear face meets the cylindrical body. There is a left arm 21 with an eyelet 5 extending axially from the rear face. After the magnets have "jumped" together, the catch is engaged by simply pressing the safety catch 14 and magnetic clasp between the thumb and forefinger. The pair of internal ear projections 17 formed transversely to the hemicylindrical shell 14 at the left unpivoted end hook around the rim 24. The ears hold the coupled clasp together and the expandable and contractible hemicylindrical shell 14 spreads apart slightly as it slips over and partially clamps around the coupled clasp and locks to prevent disengagement. The swinging catch 14 is also shown in dashed lines in the open position. At its extreme unpivoted end is shown the finger nail lifting tab 18, which is used to unlock the hinged catch from the magnetic clasp 12 and 13. FIG. 4 and FIG. 5 illustrate the two ear projections 17 which hook over the 90 degree corner 24 of the magnetic clasp end 12. A miniature helical key ring-type fastener 9 is shown permanently installed to the in situ eyelet 5 of the left clasp half 12. The key ring fastener 9 is gold soldered to the eyelet 5. This tiny key ring is shown engaged in the closed ring attachment end 7C of the customer's necklace.

FIG. 5 illustrates the modified magnetic clasp and the pivotally mounted hinged safety catch 14 in an isometric view. It is the same structure as shown in FIG. 3 with the right arm 22 and eyelet 24 being replaced with the right arm 22 and eyelet 24.

What is claimed is:

1. Magnetic necklace clasp comprising:

a small left half magnetic shell having a cylindrical portion, a front face and an opposite tapered end;

said left tapered end having an eyelet means for securing one end of a necklace or bracelet;

said front flat face of said left half magnetic shell having a cavity means for holding a piece of magnetic material;

a left core of magnetic material cemented into said cavity means with non magnetic cement and forming a flush flat surface with said front face of said left shell;

a small right half magnetic shell having a cylindrical portion, a front face, and an opposite tapered end;

said right tapered end having an eyelet means for securing the other end of the necklace or bracelet;

said front face of said right half having a cavity means for holding a piece of magnetic material;

a right core of magnetic material cemented into said cavity means of said right shell with non magnetic cement and forming a flush flat surface with said front face of said right shell;

said left and right cores of magnetic materials having opposite polarities when cemented in their respective cavities;

said left face and said right face when placed in juxtaposition with each other being magnetically attracted because said left and right cores of magnetic materials being of different polarity from each other and from said magnetic shells associated therewith and attracting one another, said left and right portions forming the magnetic clasp having dissimilar polarities when positioned adjacent to each other.

2. The magnetic clasp as recited in claim 1 wherein said left and right pieces of magnet are comprised of commercial grade neodymium iron.

3. The magnetic clasp as recited in claim 2 wherein said neodymium iron magnets are each a solid cylindrically shaped core having a diameter of about 0.125 inch or 3.12 millimeters.

4. The magnetic clasp as recited in claim 1 wherein said left and right pieces of magnet are comprised of commercial grade samarium cobalt.

5. The magnetic clasp as recited in claim 4 wherein said left and right samarium cobalt magnets are each a sold cylindrically shaped core having a diameter of about 0.125 inches or 3.12 millimeters.

6. The magnetic clasp as recited in claim 1 further comprising:

commercially available necklace or bracelet fastener means being permanently secured to one or both said eyelets for allowing said magnetic clasp to be fastened and interposed between the linkage ends a variety of commercially available necklaces or bracelets.

7. Magnetic necklace clasp and safety catch comprising:

a small left half magnetic shell formed as a cylindrical portion having a front face and a rear face;

arm means extending from said rear face and having an eyelet means for securing one end of a necklace or bracelet;

said front flat face of said left half magnetic shell having a cavity means for holding a piece of magnetic material;

a left core of magnetic material cemented into said cavity means with non magnetic cement and forming a flush flat surface said front face of said left shell;

a small right half magnetic shell having a cylindrical portion, a front face, and an opposite tapered end;

said right tapered end having an eyelet means for securing the other end of the necklace or bracelet;

said front face of said right half having a cavity means for holding a piece of magnetic material;

a right core of magnetic material cemented into said cavity means of said right shell with non magnetic cement and forming a flush flat surface with said front face of said right shell;

said left and right cores of magnetic materials having opposite polarities when cemented in their respective cavities;

said left face and said right face when placed in juxtaposition with each other being magnetically attracted because said left and right cores of magnetic materials being of different polarity and attracting one another, said left and right portions forming the magnetic clasp having dissimilar polarities when positioned adjacent to each other;

a pivotally mounted mechanical spring catch;

said spring catch having an elongate approximate hemicylindrical shell and pivotally secured at one end to an end of said right magnetic clasp half;

said unpivoted end of said catch having a pair of internal ear projections formed transversely to the hemicylindrical shell such that said portion being clamped around said other said left magnetic clasp half and being expandable and contractible by the material used in said spring and for acting as a means for locking said clasp.

8. Magnetic necklace clasp comprising:

a small left half magnetic shell having a cylindrical portion, a front face and an opposite tapered end;

said left tapered end having an eyelet means for securing one end of a necklace or bracelet;

said front flat face of said left half magnetic shell having a cavity means for holding a piece of magnetic material;

a left core of magnetic material cemented into said cavity means with non magnetic cement and forming a flush flat surface with said front face of said left shell;

a small right half magnetic shell having a cylindrical portion, a front face, and an opposite tapered end;

said right tapered end having an eyelet means for securing the other end of the necklace or bracelet;

said front face of said right half having a cavity means for holding a piece of magnetic material;

a right core of magnetic material cemented into said cavity means of said right shell with non magnetic cement and forming a flush flat surface with said front face of said right shell;

said left and right cores of magnetic materials having opposite polarities when cemented in their respective cavities;

said left face and said right face when placed in juxtaposition with each other being magnetically attracted because said left and right cores of magnetic materials being of different polarity and attracting one another, said left and right portions forming the magnetic clasp having dissimilar polarities when positioned adjacent to each other;

a pivotally mounted mechanical spring catch;

said spring catch having an elongate approximate hemicylindrical shell and pivotally secured at one end to an end of said right magnetic clasp half;

said unpivoted end of said catch having a pair of internal ear projections formed transversely to the hemicylindrical shell such that said portion being clamped around said other said left magnetic clasp half and being expandable and contractible by the material used in the spring and for acting as a means for locking said clasp.

* * * * *